United States Patent [19]

Nipko

[11] Patent Number: 5,058,343

[45] Date of Patent: Oct. 22, 1991

[54] MODULAR LOG STRUCTURES AND METHODS OF CONSTRUCTING SAME

[76] Inventor: John A. Nipko, 3615 N. Wolf Creek Dr., Eden, Utah 84310

[21] Appl. No.: 375,368

[22] Filed: Jul. 3, 1989

[51] Int. Cl.[5] ..... E04B 1/12

[52] U.S. Cl. ..... 52/233

[58] Field of Search ..... 52/233, 313, 90

[56] References Cited

U.S. PATENT DOCUMENTS 3,908,322 9/1975 Shoaf ..... 52/233 X

*Primary Examiner*—Richard E. Chilcot, Jr.

*Attorney, Agent, or Firm*—Trask, Britt & Rossa

[57] ABSTRACT

The present invention comprises a modular log structure and elements thereof which permit factory construction of a module which may be transported from the factory to a building site without damage from lifting or road fatigue. Also disclosed and comprising part of the invention and system is an alignment method and system which may be used for placement of modules of any construction at a building site.

26 Claims, 5 Drawing Sheets

MODULAR LOG STRUCTURES AND METHODS OF CONSTRUCTING SAME

BACKGROUND OF THE INVENTION

This invention relates to the field of modular housing, and particularly modular construction techniques and methods as developed for a modular log structure.

Log cabins and other structures have been in existence for centuries. Initially, such structures were built in proximity to softwood forests which provided ready and easily harvested source of building materials which could be utilized with a minimum number of finishing operations and erected using manual labor. In modern times, log cabins have been recognized as highly versatile, energy efficient structures, and a wide variety of log structures and construction techniques have been developed over the last century.

By way of example, U.S. Pat. No. 1,445,738 discloses a "portable bungalow" constructed of interlocked prefabricated wall sections of vertical half-logs. U.S. Pat. No. 1,902,309 discloses another log structure of vertical half-logs, this time using facing rows of overlapped half-logs, as does U.S. Pat. No. 1,980,309, the latter patent placing rows of half-logs on the inside and outside of a thin, centrally disposed wall.

In more modern times, other attempts have been made to construct or simulate the construction of a log structure. U.S. Pat. Nos. 4,115,969, 4,463,552 and 4,807,413 disclose various prefabricated log wall panels which are then assembled on-site into a log structure via different fastening techniques. U.S. Pat. Nos. 4,305,238 and 4,640,069 disclose techniques for simulating the appearance of log structures; U.S. Pat. No. 4,147,000 discloses a double wall log structure with insulation between the walls. Finally, U.S. Pat. Nos. 3,908,322 and 4,787,185 disclose log construction techniques utilizing interlocked logs cut and/or milled in particular patterns for speedy and easy assembly on site as well as lower air infiltration, greater weather-tightness, less warpage, etc.

All of the foregoing patents require a substantial amount of on-site assembly manpower and, consequently, time. In addition, final assembly on-site depends in large part on the skill of a local building contractor's work crew, which varies widely and may, in many instances, unfortunately result in a substandard end product. In addition, in many of the more northern latitudes where log homes are extremely popular due to their aforementioned energy efficiency, hostile weather conditions result in a very short building season, and an on site construction crew is limited to a few "stick built" structures each season. Essentially, the log home industry has traditionally suffered from its inability to utilize modular construction techniques which have been applied for years to frame type modular construction.

The reasons for the above limitation are inherent in the use of logs as building materials. Except in rare instances, logs of adequate diameter (usually 6–24 inches) are limited to a maximum of 16–20 feet in length. In addition, walls constructed of log courses are extremely heavy in comparison to a conventional framed wall of 2×4 studs. Very small log structures have in the past been preassembled and moved as a unit to an installation site, but such are limited to no more than 15 or 20 feet on a side because of the tensile and shear stresses imposed on a log wall when lifted from below by jacks, slings or cables at a few discrete lifting points. As a log wall becomes longer, the buckling tendencies of this point-type lifting are aggravated by the increased weight of the wall and the fact that the wall cannot be built of a single log from end to end, but must be constructed of several butted logs in each course. Further aggravating the strength problem of such a wall are the necessary windows and doors extending therethrough. Of course, a log structure could be jacked up, placed on rails and moved in one piece down a street or highway on wheeled carriages, as older homes are sometimes moved, but this technique is time consuming, expensive and requires special permits and road closings to accommodate the width of the structure. Therefore, such a technique is obviously impractical for long distance transport or transport to remote building sites in mountain country accessible only by gravel or even dirt roads.

SUMMARY OF THE INVENTION

In contrast to the prior art, the present invention provides modular construction components, assemblies and methods which result in a factory built modular log structure based on classic or traditional horizontally stacked log wall construction.

The present invention comprises a modular structure employing outer wall framing of horizontal logs, preferably incorporating a Swedish Cope or other semi-interlocking design bolted to a rigid floor assembly, wherein the logs themselves are lag-bolted between courses as is known in the art, but are preferably further glued together, and wherein at least one course of logs in the longer wall of each module includes a tension and shear support means to permit point-type lifting of the module at the factory and on the building site by jacks or by cables or straps of a conventional lifting device such as a rail-type lift at the factory or a crane at the building site. The present invention further comprises a technique for splicing logs end to end to comprise a much longer log of virtually any length desired which also comprises an integral tension and shear support means capable of use in the modular structure described. Finally, the invention includes a unique three point alignment system employed to self align second story modules to construct a two story modular structure with great rapidity and accuracy, and without a large work crew, jacks, or other specialized equipment.

In summary, the modular log house of the present invention can be constructed in a climate-controlled factory environment, transported to the building site, whereat a suitable foundation has been prepared, and erected in a matter of hours. The modules of the present invention may contain plumbing and fixtures, all electrical conduits, outlets, breaker boxes and exterior power connections, as well as floors, exterior doors and windows and all interior walls, doors and other components of a complete home.

BRIEF DESCRIPTION OF THE DRAWINGS

The present invention will be more fully understood by those skilled in the art through a review of the following detailed description, taken in conjunction with the accompanying drawings, wherein:

FIGS. 5A and 6B are top and side elevations, respectively, of a finger-jointed log providing integral tension and support means in accordance with the present invention;

DETAILED DESCRIPTION 0F THE PREFERRED EMBODIMENTS

Figure 1:
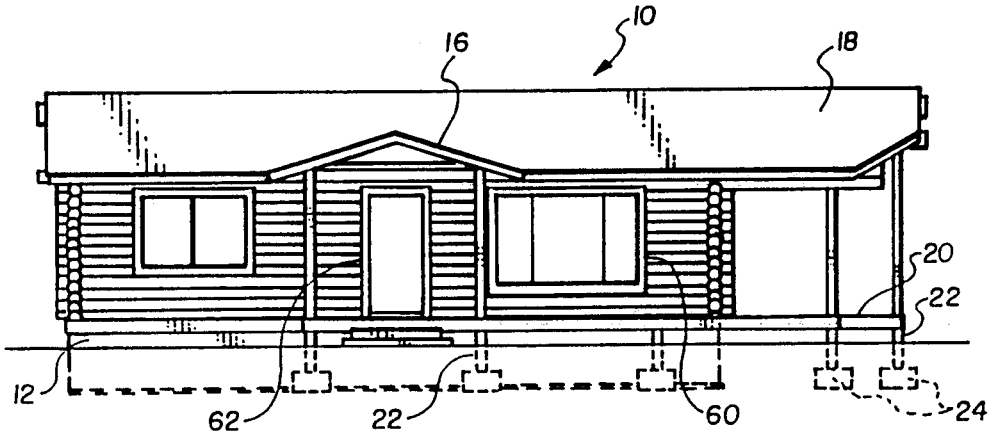
FIG. 1 is a front elevation of a modular log home constructed accordance with the present invention.
Figure 2:
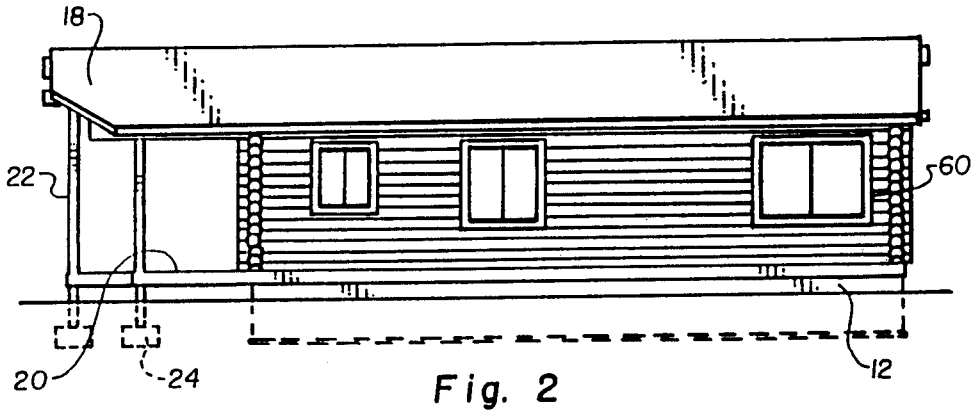
FIG. 2 a rear elevation of the log home of FIG. 1.
Figure 3:
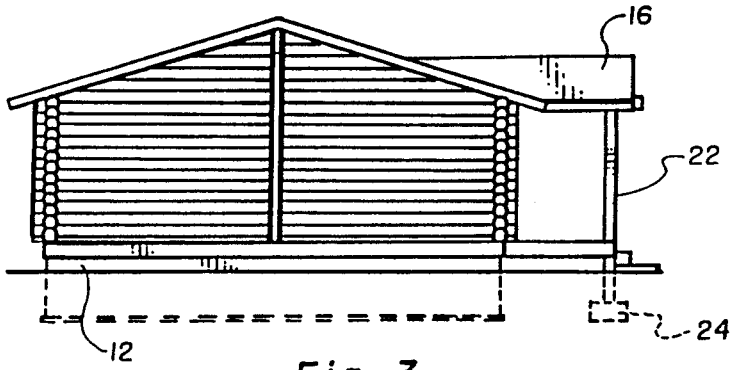
FIG. 3 is a side elevation of the log house of FIG. 1.

FIGS. 1–3 illustrate the basic constructional details of a modular log home of the present invention.

Log home 10 can be placed at the building site on either a masonry or pressure-treated wood perimeter foundation wall 12; if the latter, it is preferable to utilize at least 2×6 studs placed 16" on center. A central, longitudinally oriented bearing wall 14 of similar construction (see FIG. 4) is also employed, the purpose of which will be explained hereafter. A wood foundation is preferred due to the need for less manpower and specialized equipment, as well as time and material savings. The present invention, however, contemplates erection on both crawl space and full basement type foundations of any construction, and may even be placed on a slab.

Front porch roof 16 and side porch roof 18, as well as deck 20, extend from the perimeter of home 10, and are secured to the home by joist hangers, as is known in the art, the outer periphery of the deck 20 and the front porch and rear porch roofs 16 and 18 being supported on 6×8 wood posts 22 placed on 24"×24"×12" concrete footings 24. Foundation walls 12 and 14 and footings 24 are completed at the building site prior to the arrival of home 10 from the factory, while posts 22 and deck 20 are installed concurrently with the placement of home 10 and walls 12 and 14.

Figure 4:
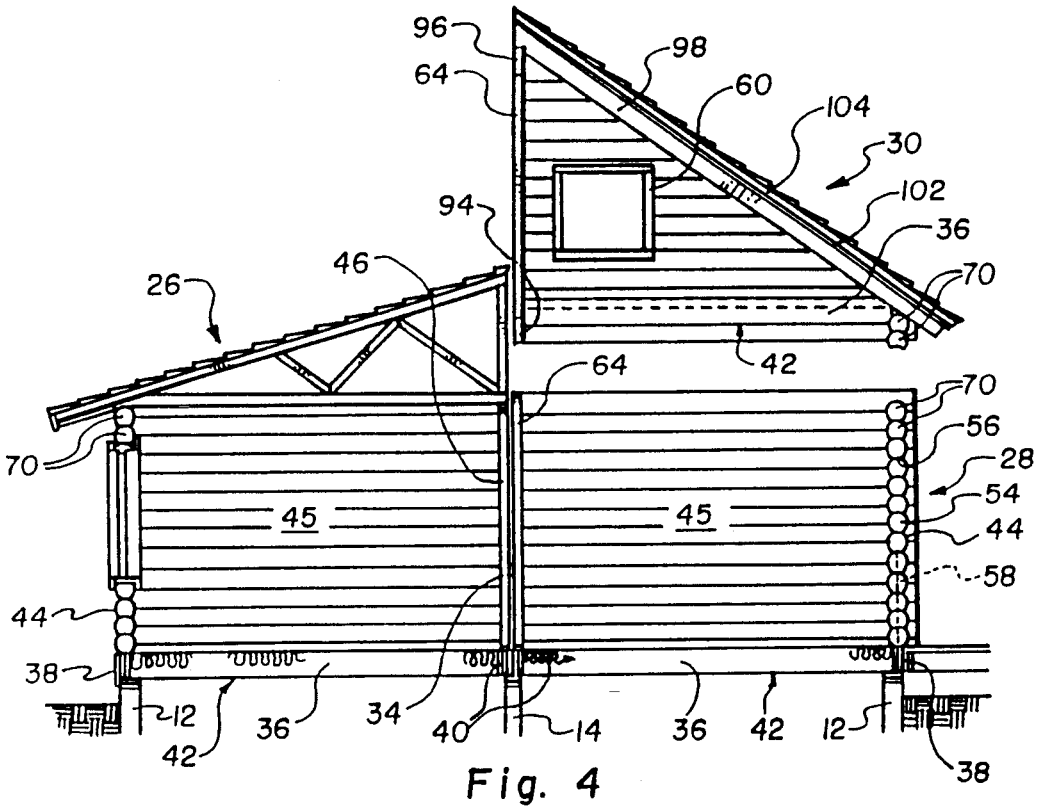
FIG. 4 illustrates a cross-section of the log home of FIG. 1, as wel an alternative two-story embodiment.

Log home 10 is constructed indoors in a factory similar to that utilized by many other non-log modular home manufacturers. Referring to FIG. 4, log home 10 may be constructed in the factory in two living area modules 26, including an integral roof or, alternatively, a first story and second-story modules 28 and 30, respectively. The living modules are joined at the longitudinal center line 34 of home 10 at the building site. Living modules 26, 28 and 30 may include all plumbing and electrical fixtures, cut outs for heating ducts, interior walls, kitchen cabinets, bathroom fixtures, interiror doors, etc. These details are not shown, as such features are commonly offered in conventional modular construction and do not form part of the present invention. Moreover, it is contemplated that many home purchasers may wish to only pay for erection of structural shell modules according to the present invention, and supply all other components and finish labor themselves.

Living modules 26 and 28 comprise, structurally, floor joists 36 center extending laterally between double rim joists 38 at the exterior longitudinal (front or rear) wall 44 and triple 2×10 center joists 40, also extending longitudinally, floor joints 36 being hung using metal hangers and being blocked or strapped to inhibit warpage and to impart additional stiffness to the floor assembly 42. Other laterally extending double rim joists 38 (not shown) parallel to floor joists 36 are placed at the ends of the floor assembly 42 in substantial alignment to end walls 45. Tongue and groove boards, waferboard, particleboard, plywood, or combinations of the foregoing, may all be utilized to form a flooring surface (unnumbered) on floor assembly 42, but the exact structure thereof is not important to the present invention.

Figure 4A:
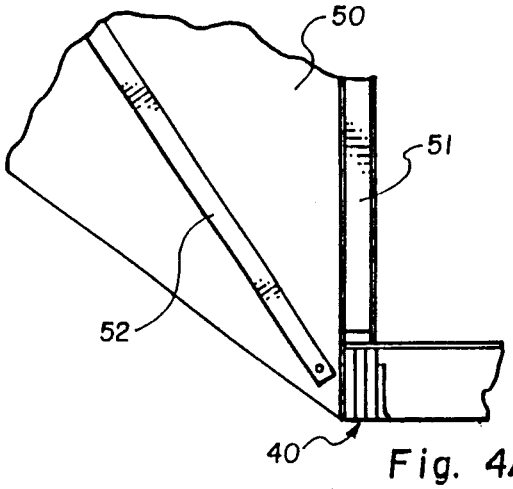
FIG. 4A is a perspective partial sectional enlargement of diaphragm wall 46 of FIG. 4.
Figure 6:
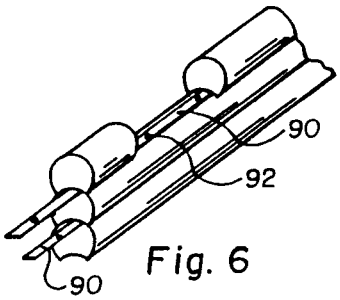
FIGS. 6, 7, 8, 9, 10, 11, 12, and 13 illustrate alternative embodiments of log wall assemblies incorporating discrete tension and shear support means in accordance with the present invention.

After floor assembly 42 of a living module is completed, exterior log walls 44 and 45 and longitudinal marriage wall 46 are constructed thereon. "Marriage" wall 46 is generally constructed at least in part as a diaphragm wall utilizing 2×4 studs sheathed on both sides with wafer board 50 glued and nailed thereto, wafer board 50 preferably extending downwardly to substantially cover center joists 40 (see FIG. 4A). In addition, orthogonally extending steel straps 52 are secured by bolts (unnumbered) to the center joists 40 through wafer board 50 on the side of wall 46 to be placed adjacent center line 34 of home 10 proximate the center of marriage wall 46 (FIG. 4A) as well as to the upper ends of posts 64 at the outer ends of marriage wall 46, creating a truss structure to impart stiffness to the center wall of the structure. End log walls 45 are secured at their ends adjacent center joists 40 to posts 64. If a portion of the home 10 extending across center line 34 is to be open, a beam, such as a so-called "glu-lam" beam constructed of stacked glued together 2×4's (or, alternatively, sistered 2×10's similar to center joists 40), extends across the open area at a level parallel to the top course of logs of the living module and is secured to the diaphragm part of the marriage wall 46 and post 64. The sole plate of the wall 46 and the lowermost course of logs of the exterior walls 44 and 45 are bolted to the center joists 40 and rim joists 38, respectively.

Exterior walls 44 and 45 are preferably constructed of six to twenty-four inch diameter logs 54, although it is contemplated that the present invention may be utilized in the construction of all "solid wood" homes comprising horizontally stacked courses of logs, beams or elongated structural elements of similar configuration. Moreover, while lodge pole pine logs milled from standing dead timber are currently the preferred material, any soft or hard wood may be employed as desired. The preferred log shape is the so called "Swedish Cope", wherein a concave cavity 56 is milled on the bottom of each log 54, the radius of the cavity 56 matching that of the logs 54, so that when stacked to construct walls 44, logs 54 fit together with precision in close proximity.

Logs 54 are notched at ends to be placed at the module outer corners to interlock in a manner well known in the art. As the logs 54 are sequentially stacked in courses to build longitudinal side wall 44 and end walls 45 from the top of floor assembly 42, the bottom course of logs, as previously noted, is secured to the rim joists 38 of intervals by lag bolts 58 countersunk flush with the top of the logs. The next course is also lag bolted to the first course, and in addition, a layer of glue, caulking or sealant (not shown) is preferably placed between the logs. This process continues until the total desired height of walls 44 and 45 is reached, the alignment and placement of the logs 54 being assisted with removable corner jigs at the inside of each corner. Where window frames 60 and door frames 62 are located, they are roughed-in using suitable size planking, logs 54 being cut to fit the space between such features. The inner ends of the end log walls 45 terminate at posts 64, to which they are glued and bolted, as previously noted. Posts 64 are preferably of three inch thickness, and of a depth to match the diameter of the logs 54 comprising end wall 45 to which they are secured. For example, one would employ a 3×9 post with nine inch diameter logs, a 3×8 post with eight inch diameter logs, etc.

When module 28 is installed at the building site, center joists 40 and thus marriage wall 46 rest on foundation bearing wall 14, while rim joists 38 are supported on the foundation perimeter wall 12.

The problem with conventional construction techniques is their inability to accommodate the tension and shear stresses placed on the side log walls 44 when a living module is lifted at the building site as an entire assembly. Logs available for construction of log homes typically span no more than sixteen to twenty feet, while even a small modular log home is at least twice that length. Where windows and doors extend through walls 44 and 45, the log spans must of necessity be even shorter and more discontinuous. When a living module is lifted using two or three straps suspended at quarter-points along the longitudinal wall span from a basket rig of crane cables, the rigidity of the rim joists 38 and the logs 54 is insufficient to prevent the entire outer longitudinal wall 44 of the module from buckling upward, at the very least causing distortion and loosening of all the joints in the module, and at the worst resulting in splitting of the window and door frames and breakage of windows, assuming that the butted logs do not separat and the rim joists crack, resulting in total structural failure.

Figure 5A:
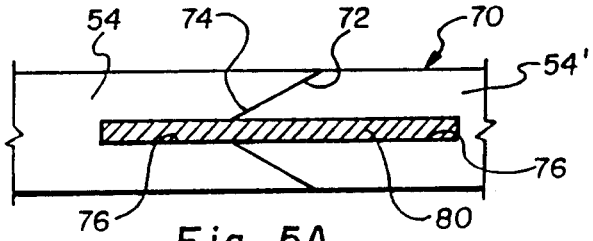
Figure 5C:
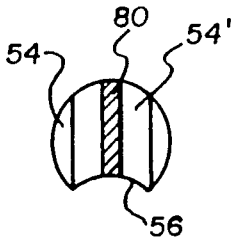
FIG. 5C is a cross section of the log of FIGS. 5A and 5B, taken across line C—C of FIG. 5B.
Figure 5B:
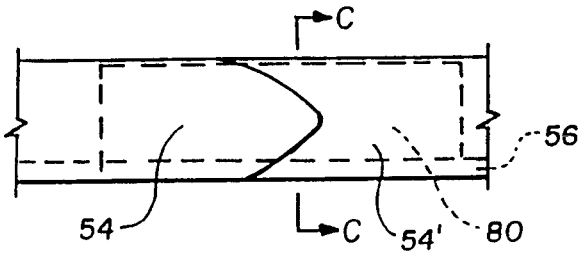
Figure 10:
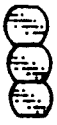
Figure 11:
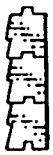
Figure 12:
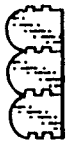
Figure 13:
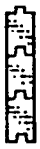

Several solutions to the above problem are proposed herein, the most preferred being shown in FIGS. 5A, 5B and 5C. Spliced log 70, comprising integral tension and shear support means, is preferably fabricated from Swedish Cope logs 54 and 54', or other logs having self aligning characteristics, such as flat bottom and top logs (FIGS. 9 and 10), square or rectangular cross section logs (FIG. 8), or logs having tongue and groove type alignment features (FIGS. 11, 12 and 13). After the logs 54 and 54' are milled to shape, the ends to be spliced together are cut on an angle, preferably 30°, to the longitudinal axis of the logs to form mating V notched recesses 72 in log 54 and V-pointed ends 74 in log 54'. An axial slot 76 is then milled in both the V notched log from the base 76 of the V-notch 72 and from the end 78 of the V-point 74. A splicing piece or key 80 is then inserted in the slots, and the logs 54 and 54' pulled together until V-point 74 is fully extended into V-notch 72, key 80 substantially filling all the slot area where logs 54 and 54' make contact.

Key 80 is preferably of a structurally strong wood, such as Douglas Fir, although other woods or wood laminates may of course be utilized. Key 80 is preferably cut from a 2×10 plank, and is two feet in length, the same as the length of slots 76 when logs 54 are closely joined by notch 72 and point 74. Key 80, as well as the interior of V-notch 72, slots 76 and the exterior of V-point 74, are coated with a superstrong glue; a heat-setting resin or epoxy may be utilized, if desired. Heat may be applied to appropriate glues to accelerate setting and development of shear strength of the splice via conventional hot air guns or via microwave apparatus, both of which devices are available commercially. Preferred glues for use with the invention are 4323 Construction Mastic and the 3700 Series of Jet-Melt Adhesives, both available from the Adhesives, Coatings and Sealers Division/3M, St. Paul, Minnesota 55144. The former is applied at ambient temperature, the latter is preheated as with a 3M Polygun glue gun. After the glue has set, excess glue and key material above and below log 70 can be easily trimmed.

Since logs 54 are self aligning with respect to their vertical orientation, cutting the points and notches and milling slots can be done quickly at the factory using conventional woodworking tools, and multiple log splices, wherein three or more logs are spliced end to end, are easily effected to give continuous spans of 40 or more feet.

Figure 16:
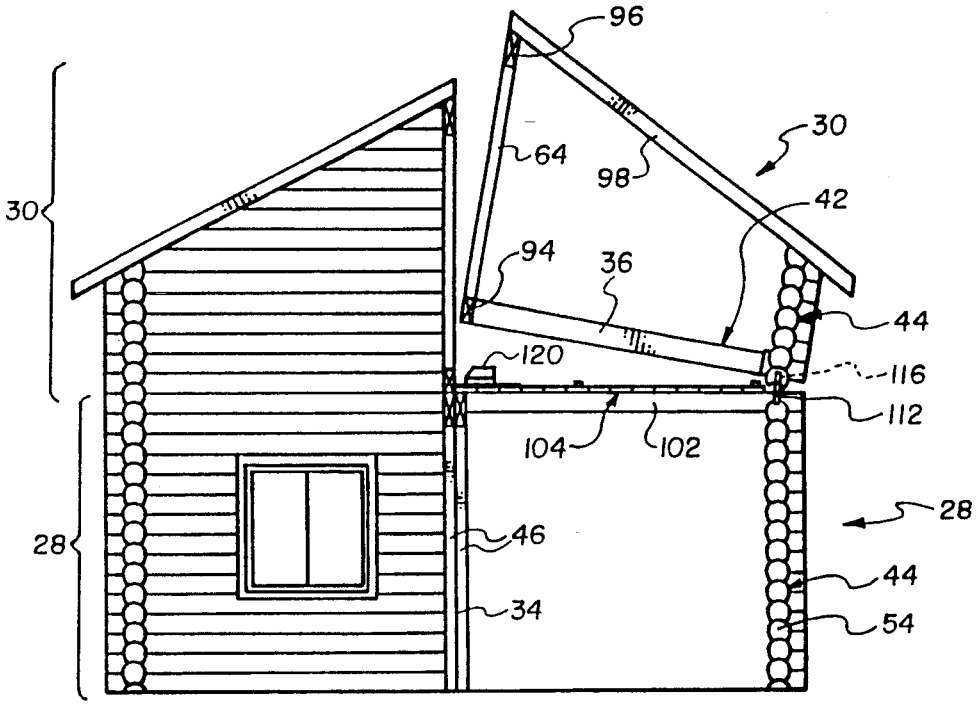
FIG. 16 illustrates a module alignment system in accordance with the present invention.

The spliced log 70 is virtually indistinguishable from a single log 54, and can be stained or treated in similar fashion. Even more significant, spliced log 70 is as strong or stronger in shear and tension than a single log of the same length. Therefore, one or two spliced logs 70 are utilized in log home 10 of the present invention as the top log courses above any apertures, such as windows or doors, on longitudinally extending exterior walls 44 on modules 26 or 28, or at the outer extent of module 30 at least in the course on which the rafters sit, but preferably also in the lowermost course of the module 30, particularly if wall 44 of module 30 has a large number of courses as depicted in FIG. 16.

When modules 26, 28 or 30 are lifted at their quarter points, the combined rigidity of the rim and center joists 38 and 40 with marriage wall 46, end log walls 45 and the spliced logs 70 in side wall 44 provide adequate structural rigidity to the modules to resist the aforementioned distortion and buckling.

Figure 7:
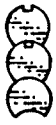
Figure 8:
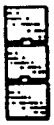
Figure 9:
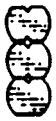

In the event one cannot or does not wish to construct spliced logs 70, an alternative embodiment of the present invention, illustrated in FIGS. 6–9, utilizes discrete tension and shear support means 90 secured at intervals 92 to the logs 54 of several of the top log courses. Tension and shear support means 90 preferably comprises steel strapping which is secured to logs 54 by lag bolts, screws, staples, spikes or other suitable means. Steel straps are advantageously used due to their thin cross section, but other means such as steel cable, chain, or Kevlar or Dacron rope or strapping are also suitable. To use rope, cable or chain, it is necessary to mill recesses in the log tops and/or bottoms, such as are shown in FIGS. 7–9 in conjunction with logs of different cross-sections, in order to accommodate their cross-sectional depth and permit mating of the stacked log courses.

Figure 21:
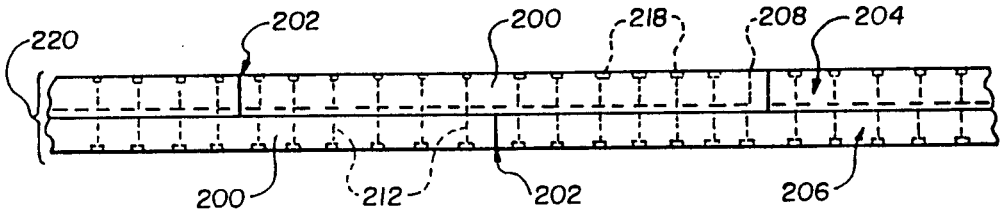
FIGS. 21 and 21A are a side elevation and an enlarged section, respectively, of another alternative tension and shear support means usable in a log according to the present construction structure invention.
Figure 21A:
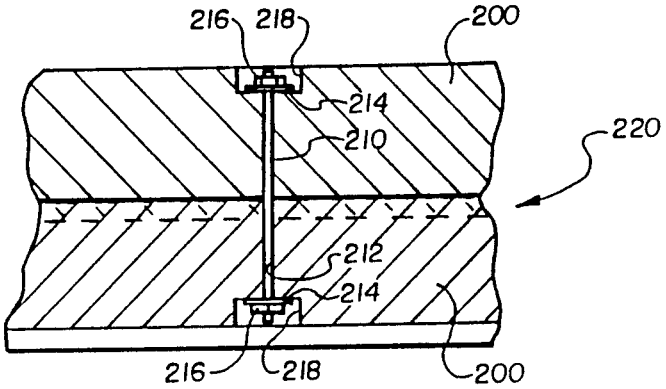

Yet another alternative embodiment of the tension and shear support means of the present invention is depicted in FIGS. 21 and 21A. In lieu of a spliced log or the use of straps, chains, etc. to provide necessary support to a module during lifting, a number of log segments of normal length, i.e., 16–20 feet, may be interlocked and utilized as a unit.

Referring to FIG. 21, logs 200 may be placed in end to end abutting relationship in two courses, joints 202 being staggered between course 204 and course 206. Butt joints 202 may be flat, as shown, or may be notched, as indicated by broken line 208, to aid with alignment during assembly.

Referring to FIG. 21A, through bolts or rods 210 are placed in boxes 212 extending through both course of logs 204 and 206. Both ends of bolts 210 are threaded, and large washers 214 are maintained thereon by nuts 216. Washers 214 may be round as shown at the bottom of FIG. 21A, or square or rectangular plates to provide more contact area with logs 200. Lock units or chemical locking compounds may be applied to key nuts 216 from backing off. Nuts 216 and the ends of bolts 210 ar countersunk in recesses 218 in logs 200 and thus are invisible from the side and do not interfere with stacking of log courses in construction of the log module. Bolts 210 are placed at approximately one foot intervals throughout the entire length of coextending log courses 204 and 206, but not closer than six inches to joints 202 to prevent splitting. Bolts 210 and associated hardware may be of any commonly available low alloy steel and of sufficient diameter, for example one-half inch, to bind courses 204 and 206 together. It is also preferable to utilize a layer of glue between courses 204 and 206 and at joints 202, a glue of the type previously referred to herein being entirely suitable.

When nuts 216 are torqued down on washers 214, logs 202 in courses 204 and 206 are tied together as a single beam like unit 220, which is capable, as in the other embodiments, of resisting the lifting loads imposed on a log module according to the present invention. Unit 220 typically will be placed above the windows and doors of a module 28 in lieu of the top two courses of logs 54 or 70 normally utilized. In a second story module 30, two courses of logs may be through-bolted to log segments 100 (see FIGS. 14 and 15) to form a unit. If a second story module 30, as depicted in FIG. 16, is to be built, it is preferred that both the top two and bottom two full courses of wall 44 be replaced with a unit 22.

Figure 14:
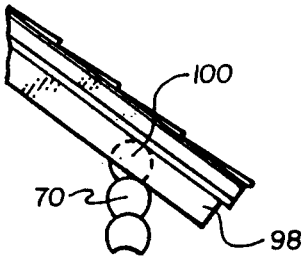
FIG. 14 is an enlarged view of the rafter placement on the second log module of FIG. 4.
Figure 15:
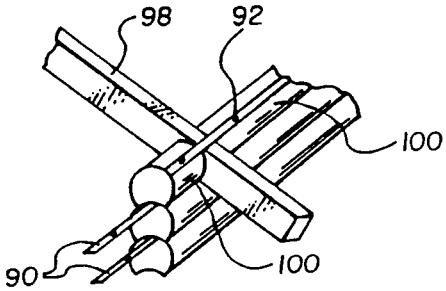
FIG. 15 a sectional perspective view showing the manner in which tension and shear support means are employed in the second story module of FIG. 4.

Referring again to FIG. 4, this time in conjunction with FIGS. 14 and 15, the details of second story module 30 will be described. Roof module 30 includes a floor assembly 42 substantially similar to those of modules 26 and 28. The outer side of assembly 42 is bolted to the longitudinally extending logs 54 or 70 (if spliced logs are utilized) comprising a side wall 44. The inner side of assembly 42 is bolted to a beam 94 (which may comprise a stack of glue laminated 2×4's or a sandwich of sistered 2×8's), the ends of which are bolted to posts 64 like those used in modules 26 and 28. Ridge beam 96 extends longitudinally across module 30, resting on posts 64 and bolted thereto. Rafters 98 are notched at their top ends and rest on beam 94. Alternatively, a diaphragm type wall may be used, as with first story module 28, as a marriage wall proximate the center line of the structure. The outer ends of rafters 98 rest on the uppermost full log 70 at the outside longitudinal wall of the module 30, and are lag-bolted thereto. Log sections 100 are placed between rafters 98, and are glued and lag bolted to top log 70. A tension and shear support element, such as the aforementioned steel strap 90, is run across the tops of rafters 98 and secured at 92 to log sections 100 in a manner heretofore described. As shown in FIG. 15, if spliced logs 70 are not used, the top and bottom full courses of logs 54 should be reinforced with a discrete tension and shear support element 90. If a module 30 utilizes a large number of log courses in wall 44, such as shown in FIG. 16, the lowermost two courses are preferably also reinforced with elements 90.

The roof of module 30 is conventional, with tongue and groove planks 102 resting on rafters 98, and a rigid foam insulation board 104 laminated to wafer board (unnumbered) placed over planks 102, the wafer board forming roof decking to which shingles are secured.

It should be readily apparent to one of ordinary skill in the art that side log walls 44 (which may also be termed "stress" walls) utilizing tension and shear support means of the present invention provides, in conjunction with a center marriage wall 46 of truss or post and beam construction, a modular assembly having the ability to resist "road fatigue" caused by transport of the module. The marriage wall and tension and shear supported log walls have similar structural characteristics with respect to stress encountered during transport and that undergone when lifted by straps during placement at the building site. End walls 45, acting as "brace" walls, and floor assembly 42, being secured to marriage wall 46, end walls 45 and side walls 44, provide rigidity against torsional or "twisting" stress on the module resulting from flexing of the trailer on which the module is transported, and from variations in the symmetry of placement of lifting straps of the crane's basket rig, as well as differences in strap tension and stretch during the early phases of lifting.

Modules according to the present invention may thus be transported by truck from the factory to the building site where the pre-prepared foundation awaits, and lifted from the truck trailer by straps disposed at pre selected points along the parallel marriage and stress walls, 46 and 44, respectively, from a basket rig of a portable crane. Such lifting apparatus is conventional and well-known, and will not be further described. Modules are aligned over the foundation, and secured thereto, as by bolts. Since the large weight and inertia of the modules presents a handling and alignment problem, there has also been developed a novel and unobvious alignment system which will next be described.

Referring now to FIGS. 16–20 of the drawings, a module alignment system forming part of the present invention will be described.

FIG. 16 of the drawings illustrates a two story log home 10 according to the present invention, this embodiment comprising two first story modules 28 and two second-story modules 30. First story modules 28 have been constructed as previously described in conjunction with FIGS. 1–15, as have second story modules 30. However, it should be understood at this point that the module alignment system of the present invention will be described in conjunction with log home modules for purposes of illustration and not by way of limitation, as the alignment system is applicable to any type of modular construction, particularly multi-story modular construction.

Briefly, first story modules 28 have been placed on a crawlspace, basement or other suitable foundation as heretofore described. Marriage walls 46 adjoin the center line 34 of the structure. At the left hand side of FIG. 16, second story module 30 has already been placed on first story module 28 utilizing a basket-rig with a crane 1 at the building site, as previously described. Details of the structure, including the foundation and floor assembly for modules 28, have been omitted for simplicity. At the right-hand side of FIG. 16, first story module 28 and second story module 30 are shown in schematic section, structural elements similar to those of FIG. 4 being numbered the same for convenience. The floor (not shown) of second story module 30 may comprise ½" particleboard glued and nailed through ½" waferboard to floor joists 36 of floor assembly 42.

Log rafters or beams 102 are shown extending from marriage wall 46 of right hand module 28 to wall 44 on four foot centers, supporting 1×8 tongue and groove planks 104 used as the first floor ceiling, planks 104 serving also to weather proof the top of module 28 during transport to the building site.

Wall 44 on right hand module 28, extending perpendicular to the drawing sheet, carries an alignment pin 112 at each end thereof, alignment pins 112 being placed either inboard or outboard of the notched wall junction between the end or brace walls 45 at the ends of log home 10 and the longitudinal stress or side wall 44 extending therebetween, inboard or outboard placement being less important than symmetrical placement. Pins 112 may be of any suitable material, but are preferably of two inch diameter steel rod having a tapered upper end 114. Referring to the enlarged view of FIG. 17, pins 112 are sunk into vertical holes bored in the top log course of wall 44, and may be glued, interference fit, threaded, or otherwise secured therein when the module 28 is built at the factory. The bottom course of logs 54 of wall 44 of second story module 30 has alignment bores 116 therein, spaced the same distance apart as are pins 112 in module 28. Alignment bores 116 are preferably lined with a tubular sleeve (unnumbered) of any suitable material, such as steel, brass, or PVC, to engage pins 112 and prevent splitting of the bored log from lateral stresses as pins 112 engage bores 116 as module 30 is aligned on module 28. Intersecting alignment bores 116 are lateral locking bores 118, through which locking pins can be inserted after module 30 is resting on module 28, the pins extending through holes in alignment pins 112, whereby the modules are permanently and securely locked together. For cosmetic purposes, the outer ends of locking bores 118 may be closed with wood plugs.

Figure 18:
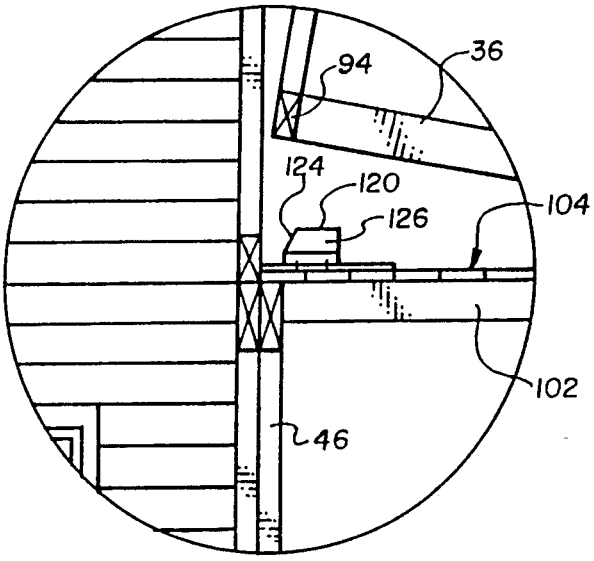
FIG. 18 comprises an enlarged view of the alignment block and placement thereof as shown in FIG. 16, as used in the alignment system at the present invention.
Figure 17:
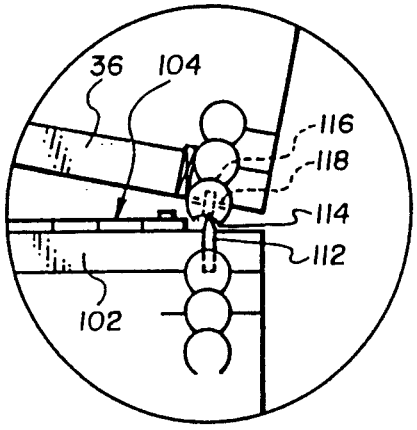
FIG. 17 comprises an enlarged view of the alignment pins and bores shown in FIG. 16, as used in the alignment system of the present invention.
Figure 19:
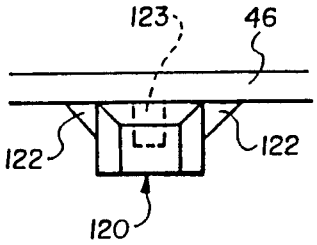
FIGS. 19 and 20 are top elevations illustrating alternative means of supporting the alignment block shown in FIG. 16.
Figure 20:
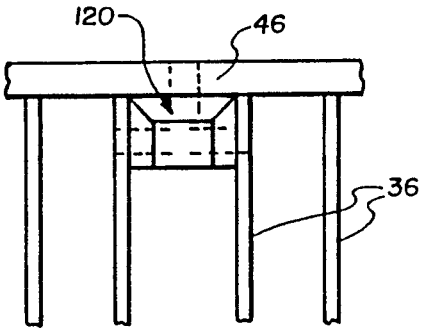

Referring to the enlarged view of FIG. 18, an alignment block 120 is shown secured and braced to marriage wall 46. Block 120 is preferably a wood laminate, although other materials, such as plastic, could be employed. Block 120, like pins 112, is part of module 28 as built at the factory. Block 120 is glued and lag-bolted to plywood panel 121, and supported from below by planks 104 and beams 102. Ideally, lag-bolts extend into at least one beam 102 for extra strength. Plywood panel 121 is glued to planks 104 and serves, with planks 104, to distribute the downward load during installation of module 30 when it contacts block 120. Block 120 may, instead of being secured as shown in FIG. 18, be bolted to marriage wall 46 and supported laterally by wedges 122 and from below by a post 123. This construction can also be used, in conjunction with the alighnment pin/bore arrangement, to align a first story module on a foundation bearing wall. Alternatively, block 120 may be positioned and secured as by bolts between laterally extending joists 36 running across the top of module 28 (see FIG. 20) and to marriage wall 46. Referring again to FIG. 18, the top center edge 124 of block 120 is bevelled, as are the top side edges 126.

Alignment block 120 is preferably positioned adjacent a marriage wall 46 of a module, and is also preferably longitudinally positioned between the alignment pins 112 or at least at a position no farther longitudinally outboard than a pin 112 itself. More preferably, alignment block 120 is positioned generally longitudinally centered between pins 112, so as to substantially form an isosceles triangle with pins 112. If desired, although not preferred, more than one alignment block 120 may be employed, both blocks 120 being placed either longitudinally within or outside of pins 112 to form a substantially regular trapezoid. The most important consideration with respect to alignment block positioned is symmetry, so that stresses created when a module 30 contacts an alignment block 120 are relatively evenly distributed, thus avoiding or minimizing twisting or torsional stresses on module 30 before it comes to rest during the placement operation.

Referring again to FIG. 16, the method of placing second-story module 30 on first-story module 28 utilizing the alignment system of the present invention will be described. When module 28 is secured to the foundation, module 30 is lifted thereover by the same type of crane and basket rig assembly previously described. Because the side wall 44 of the module 30 is heavier than the center of the modules, module 30 will be tilted as shown. Module 30 is then centered by the crane operator so that alignment bores 116 are substantially centered over pins 112 of module 28, fine placement being achieved by the site crew, and lowered onto pins 112, thereby aligning the outer walls 44 of both modules. Continued lowering of module 30 rotationally lowers the center of module 30, and specifically beam 94, downwardly. Beam 94 contacts top center edge 124 of alignment block 120, and module 30 is thus pulled toward center line 34 of log home 10 by its own weight. Floor joists 36 of module 30 are 2×8's preferably spaced 16 inches on center to pass on either side of block 120, and bevelled side edges 126 serve to align joists 36 with block 120 and thus floor assembly 42 and module 30, in conjunction with the interaction of alignment pins 112 and alignment bores 116. After module 30 is in place, locking pins are inserted, and the ends of lateral locking bores 118 are plugged. The center wall of module 30 is also secured to that of module 28. A three point alignment of module 30 with module 18 is thus effected, largely utilizing module 30's own weight, in contrast to prior art placement methods for second story modules, wherein the module's weight and inertia proved a hindrance.

While the alignment syste of the present invention has been illustrated with log home modules, it may be used with any type of modular construction. Further, the alignment system may be used to place single story modules on foundations as well as roof modules on living modules and is not limited to use in two story structures, but may be used for construction of three or more story structures using modules of appropriate bearing strength.

The present invention has been described in terms of preferred embodiments, but those skilled in the art will readily appreciate that it is not so limited. Many additions, deletions and modifications to the preferred embodiment may be made without departing from the spirit and scope of the claimed invention. For example, and not by way of limitation, other log cross sectional configurations may be employed; other key materials, such as metal or plastic, are usable in splicing logs; a floor assembly using beams in lieu of joists and supporting a tongue and groove floor may be employed; a full height second story module utilizing a truss type roof may be constructed according to the present invention; non-rectangular modules, such as triangular modules having at least one log stress wall, may be constructed; quarter-home modules having one log stress wall and one log brace wall may be built; alignment pins may be placed in the top module and alignment bores in the lower module; alignment blocks may be placed in a top module facing downward to contact structural elements in a lower module; and more.

I claim:

1. A modular structure, comprising:

a substantially rigid, rectangular, planar floor assembly;

at least one wall comprising horizontally oriented courses of elongated structural elements disposed in a substantially vertical stack, said element wall being secured to and aligned with one side of said rectangular floor assembly, and each of said element courses being secured to those above and below;

tension and shear support means associted with at least one element course of said element wall;

brace wall means aligned with the two sides of said floor assembly perpenicular to said one sie and secured to said floor assembly and to said element wall at two points for maintaining said element wall on substantially perpendicular relationship to said floor assembly; and a marriage wall aligned with and secured to the fourth side of said floor assembly in parallel relationship to said one element wall, said marriage wall also being secured to said brace wall means.

2. The structure of claim 1, wherein said tension and shear support means is located proximate the top of said element wall.

3. The structure of claim 1, wherein said marriage wall comprises, at least in part, a truss wall.

4. The structure of claim 3, wherein said brace wall means are secured proximate their ends to the ends of said element wall and said truss wall.

5. The structure of claim 4, wherein said tension and shear support means is located proximate the top of said element wall.

6. A modular structure, comprising:

at least one longitudinally extending stress wall comprised of elongated structural elements disposed in a substantillly vertical stack and including tension and shear support means therein;

at least two brace wlal means secured to said stress wall means in substantially perpendicular relationship thereto; and a marriage wall of similar length and disposed in parallel, spaced relationship to said stress wall, said brace wall means being secured to said marriage wall.

7. The structure of claim 6, wherein said marriage wall comprises, at least in part, a truss wall.

8. The structure of claim 6, further including roof means secured to said marriage wall and said stress wall and extending therebetween.

9. The structure of claim 8, wherein said roof means comprises rafters extending substantially perpendicularly to said stress wall and said marriage wall, said rafters resting on a substantially continuous course of stress wall elements and being laterally separated by element segment interposed therebetween, said stress wall further including tension and shear support means extending over said rafters and segments and secured to at least some of said segments.

10. A spliced elongated structural element having tension and shear strength characteristics at least equal to a single element of the same material, length and diameter, comprising:

a first segment having a longitudinally extending notch at one end thereof;

a second segment having a longitudinally extending point of mating configuration to said notch at one end thereof;

a slot extending longitudinally into said first segment from the base of said notch;

a slot extending longitudinally into said second segment from the end of said point, said slots being co-aligned when said point is inserted into said notch;

a key dimensioned to substantially fill said co-aligned slots when said point is inserted into said notch; and means to secure said key to said segments and said segments to each other in proximity to said splice.

11. The element of claim 10, wherein said notch and said point are symmetrical with respect to the longitudinal axis of the element.

12. The element of claim 11, wherein said notch and said point are cut at an angle of substantially 30° to the longitudinal axis of the element.

13. The element of claim 10, wherein said segments and said key comprise wood products.

14. The element of claim 13, wherein said means to secure comprise an adhesive.

15. The element of claim 10, wherein said means to secure comprise an adhesive.

16. An alignment system for aligning a building module during placement on another structure, comprising:

alignment pin means secured to one of said structure or said module, comprising two pin elements spaced along an outer wall;

alignment bore means in the other of said module or said structure, comprising two alignment bore elements laterally spaced at the same distance as said pin elements and located in an outer wall;

an alignment block element secured to one of said module or said structure and perpendicularly horizontally removed from said outer wall, whereby a triangle is formed by said three elements; and an alignment block receiving element associated with the other of said module and said structure and perpendicularly horizontally removed from said outer wall to the same extent and in the same direction as said alignment block element.

17. The system of claim 16, wherein said alignment block and receiving element are positioned substantially at the mid point of said same distance.

18. A modular structure, comprising:

a substantially rigid, rectangular, planar floor assembly;

at least one wall comprising horizontally oriented courses of elongated structural elements disposed in a substantially vertical stack, said element wall being secured to and aligned with one side of said lfoor assembly, and each of said element courses being secured to those above and below;

first and second brace wall means secured to said floor assembly aligned with two sides of said floor assembly perpendicualr to said one side and secured to said element wall for maintaining said element wall n substantially parpendiular relationship to said floor assembly; and a marriage wall aligned with and secured to the fourth side of said floor assembly in parallel relationship to said element wall, said marriage wall also being secured to said brace wall means.

19. The structure of claim 18, wherein said marrigae wall comprises, at least in part, a truss wall.

20. The structure of claim 19, wherein said brace wall means are secured proximate their ends to the ends of said element wall and said truss wall.

21. The structure of claim 20, wherein said element wall includes tension and shear support means associated with at least one element course.

22. the structure of cliam 21, wherein said tension and shear support means is located poximate the top of said element wall.

23. A modular structure, comprising:

at least one longitudinally extending stress wall comprised of elongated structural elements disposed in a substantially vertical stack and including tension and shear support means therein;

at least wo brace wall means secured to said stress wall means in substantially perpendicualr relationship thereto;

a substantially rigid, polygonal, planar floor assembly secured to said stress wall and said brace wall means; and a marriage wall of similar length and disposed in parallel, soaced relationship to said sress wall, said marriage wall being secured to said brace wall means and to said floor assembly.

24. The structure of claim 23, wherein said marriage wall comprises, at least in part, a truss wall.

25. The structure of claim 23, futher including roof means secured to said marriage wall and said stress wall and extending therebetween.

26. The structure of claim 25, wherein said roof means comprises rafters extending substantially perpendicularly to said stress wall and said marriage wall, said rafters resting on a substantially continuous course of stress wall elements and being laterally separated by element segments intrerposed therebetween, said stress wall further including tension and shear support means extending over said rafters and segments and secured to at least some of said segments.

* * * * *

UNITED STATES PATENT AND TRADEMARK OFFICE

CERTIFICATE OF CORRECTION

PATENT NO. : 5,058,343

DATED : October 22, 1991

INVENTOR(S) : John A. Nipko

It is certified that error appears in the above-identified patent and that said Letters Patent is hereby corrected as shown below:

Column 3, line 5, change "6B" to --5B--.
Column 5, line 51, change "separat" to --separate--.
Column 7, line 15, change "course" to --courses--;
Column 7, line 22, change "ar" to --are--.
Column 8, line 41, change "pre" to -- pre- --.
Column 10, line 55 change "syste" to --system--.
Column 11, line 2 change "cross sectional" to --cross-sectional--;
Column 11, line 7, change "truss type" to --truss-type--;
Column 11, line 28, change "associted" to --associated--;
Column 11, line 31, change "perpenicular" to --perpendicular--;
Column 11, line 31, change "sie" to --side--;
Column 11, line 55, change "substantillly" to --substantially;
Column 11, line 57, change "wlal" to --wall--.
Column 13, line 1, change "lfoor" to --floor--;
Column 13, line 5, change "perpendicualr" to --perpendicular--;
Column 13, line 22, change "the" to --The--;
Column 13, line 7, change "n" to --in--;
Column 13, line 7, change "parpendiular" to --perpendicular--;
Column 13, line 22, change "cliam" to --claim--.
Column 14, line 3, change "wo" to --two--;
Column 14, line 10, change "soaced" to --spaced--;
Column 14, line 10, change "sress" to --stress--.

Signed and Sealed this

Thirtieth Day of March, 1993

*Attest:*

STEPHEN G. KUNIN

*Attesting Officer*

*Acting Commissioner of Patents and Trademarks*